US009126808B2

(12) United States Patent
Komatsu

(10) Patent No.: US 9,126,808 B2
(45) Date of Patent: Sep. 8, 2015

(54) ELEVATOR CONTROL DEVICE

(75) Inventor: Masashi Komatsu, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 564 days.

(21) Appl. No.: 13/634,902

(22) PCT Filed: May 18, 2010

(86) PCT No.: PCT/JP2010/058349

§ 371 (c)(1),
(2), (4) Date: Sep. 14, 2012

(87) PCT Pub. No.: WO2011/145170

PCT Pub. Date: Nov. 24, 2011

(65) Prior Publication Data

US 2013/0001019 A1 Jan. 3, 2013

(51) Int. Cl.
*B66B 1/20* (2006.01)
*B66B 1/24* (2006.01)

(52) U.S. Cl.
CPC ..... *B66B 1/2458* (2013.01); *B66B 2201/102* (2013.01); *B66B 2201/241* (2013.01); *B66B 2201/243* (2013.01)

(58) Field of Classification Search
CPC ..... B66B 1/2458; B66B 2201/102; B66B 2201/241; B66B 2201/243
USPC ..... 187/247, 380–389, 391, 392, 393
See application file for complete search history.

(56) References Cited

U.S. PATENT DOCUMENTS 3,851,733 A * 12/1974 Sackin et al. ..... 187/387
4,365,694 A * 12/1982 Bittar ..... 187/381
5,058,711 A * 10/1991 Tsuji ..... 187/383
5,159,163 A * 10/1992 Bahjat et al. ..... 187/381
6,808,049 B2 * 10/2004 Brand et al. ..... 187/383

(Continued)

FOREIGN PATENT DOCUMENTS

JP 56 173575 12/1981
JP 60 78366 5/1985

(Continued)

OTHER PUBLICATIONS

Translation JP 2003-118944.*
English Translation of the International Preliminary Report on Patentability issued Dec. 20, 2012 in PCT/JP2010/058349.
English Translation of the Written Opinion issued Feb. 1, 2011 in PCT/JP2010/058349.

(Continued)

*Primary Examiner* — Anthony Salata
(74) *Attorney, Agent, or Firm* — Oblon, McClelland, Maier & Neustadt, L.L.P.

(57) ABSTRACT

In an elevator control device that transfers an elevator to pause operation when predetermined pause conditions are met, the elevator operation can be changed over properly according to the call cutoff state without decreasing the building security. This control device includes a pause operation selecting means and a car call cutoff means. The pause operation selecting means stops a car at a predetermined pause floor, closes a door after door opening motion, and pauses the elevator by selecting pause operation if predetermined pause conditions are met. The car call cutoff means prohibits a car call from being registered from a car call button in the car by cutting off the car call. The configuration is made such that when the car call to the pause floor has been cut off by the car call cutoff means, even if the predetermined pause conditions are met, the elevator is not transferred to pause operation.

6 Claims, 3 Drawing Sheets

(56) References Cited

U.S. PATENT DOCUMENTS

| | | | | |
|---|---|---|---|---|
| 7,650,967 | B2 * | 1/2010 | SikShin et al. | 187/249 |
| 7,866,446 | B2 * | 1/2011 | Lindegger | 187/393 |
| 7,942,246 | B2 * | 5/2011 | Saarikoski et al. | 187/290 |
| 2011/0308896 | A1 * | 12/2011 | Suzuki et al. | 187/384 |
| 2012/0168261 | A1 * | 7/2012 | Takeshima et al. | 187/385 |

FOREIGN PATENT DOCUMENTS

| | | |
|---|---|---|
| JP | 61 39737 | 11/1986 |
| JP | 2 132081 | 5/1990 |
| JP | 2000 7235 | 1/2000 |
| JP | 2003 118944 | 4/2003 |
| JP | 2006 8268 | 1/2006 |

OTHER PUBLICATIONS

Combined Office Action and Search Report issued Dec. 24, 2013 in Chinese Patent Application No. 201080066612.0 with partial English translation and English translation of categories of cited documents.

International Search Report Issued Feb. 1, 2011 in PCT/JP10/058349 Filed May 18, 2010.

Office Action issued Oct. 17, 2013 in Korean Patent Application No. 10-2012-7027108 with English language translation.

Korean Office Action issued Apr. 15, 2014, in Korea Patent Application No. 10-2012-7027108 (with English translation).

Office Action issued Oct. 8, 2013, in Japanese Patent Application No. 2012-515659 with partial English translation.

* cited by examiner

ELEVATOR CONTROL DEVICE

TECHNICAL FIELD

The present invention relates to an elevator control device provided with both of a pause operation function and a call cutoff function.

BACKGROUND ART

Patent Literature 1 describes an elevator control device that performs predetermined parking operation automatically when the car call to a specified floor is cut off. Specifically, in the elevator control device described in Patent Literature 1, the fourth and fifth floors in a five-storied building are set to the specified floors, and when car calls to both of the fourth and fifth floors are cut off, parking operation for running a car to the fifth floor (the predetermined parking floor) is performed.

Patent Literature 2 discloses an elevator control device in which a switch for changing over elevator operation to parking operation is installed at a place separate from the elevator, for example, on a control panel.

CITATION LIST

Patent Literature

Patent Literature 1: Japanese Patent Laid-Open No. 2000-7235

Patent Literature 2: Japanese Utility Model Laid-Open No. 60-78366

SUMMARY OF INVENTION

Technical Problem

Some elevators change over the operation thereof to pause operation when predetermined pause conditions are met.

The pause operation referred to herein somewhat differs in its control content from the parking operation described in Patent Literatures 1 and 2. That is, in the pause operation, after an elevator car has been run to a predetermined pause floor, an elevator door is opened once to allow the passenger in the car to get off the car. Then, when the door closing motion is finished after the door opening motion at the pause floor, the elevator is transferred into a predetermined pause state, and the operation thereof is paused.

Also, to improve the security of building, in some elevators, a call (service) is cut off as described in Patent Literature 1.

In the case where an elevator is provided with both of the pause operation function and the call cutoff function, for example, if the building caretaker changes over the elevator operation to pause operation without confirming the car call cutoff state for the pause floor, there is a fear that the door opening motion is performed at the pause floor for which a car call is cut off. Such a problem is liable to occur especially in the case where a switch or the like for accomplishing changeover to the pause operation is installed at a place separate from the elevator, for example, in a building caretaker room.

The above-described problem can be solved if the pause operation is canceled, for example, when the car call to the pause floor is cut off by causing the car call cutoff function at the pause floor to take precedence over the pause operation function. In this case, however, even when the elevator is pausing at the pause floor normally (in the state in which no passenger is present in the car), the pause operation is canceled by the cutoff of car call to the pause floor, which presents a problem that the normal function of pause operation is also impaired.

The present invention has been made to solve the above-described problems, and an object thereof is to provide an elevator control device that transfers the elevator to pause operation when predetermined pause conditions are met, and can change over the elevator operation properly according to the call cutoff state without decreasing the security of building.

Solution to Problem

An elevator control device of the invention is a device which comprises pause operation selecting means for stopping a car at a predetermined pause floor, closing a door after door opening motion, and pausing an elevator by transferring the elevator to pause operation if predetermined pause conditions are met, and car call cutoff means for prohibiting a car call from being registered from a car call button in the car by cutting off the car call. When the car call to the pause floor has been cut off by the car call cutoff means, even if the predetermined pause conditions are met, the pause operation selecting means does not transfer the elevator to pause operation.

Advantageous Effect of Invention

According to the present invention, in the elevator control device that transfers the elevator to pause operation when predetermined pause conditions are met, the elevator operation can be changed over properly according to the call cutoff state without decreasing the security of building.

DESCRIPTION OF EMBODIMENT

Figure 1:
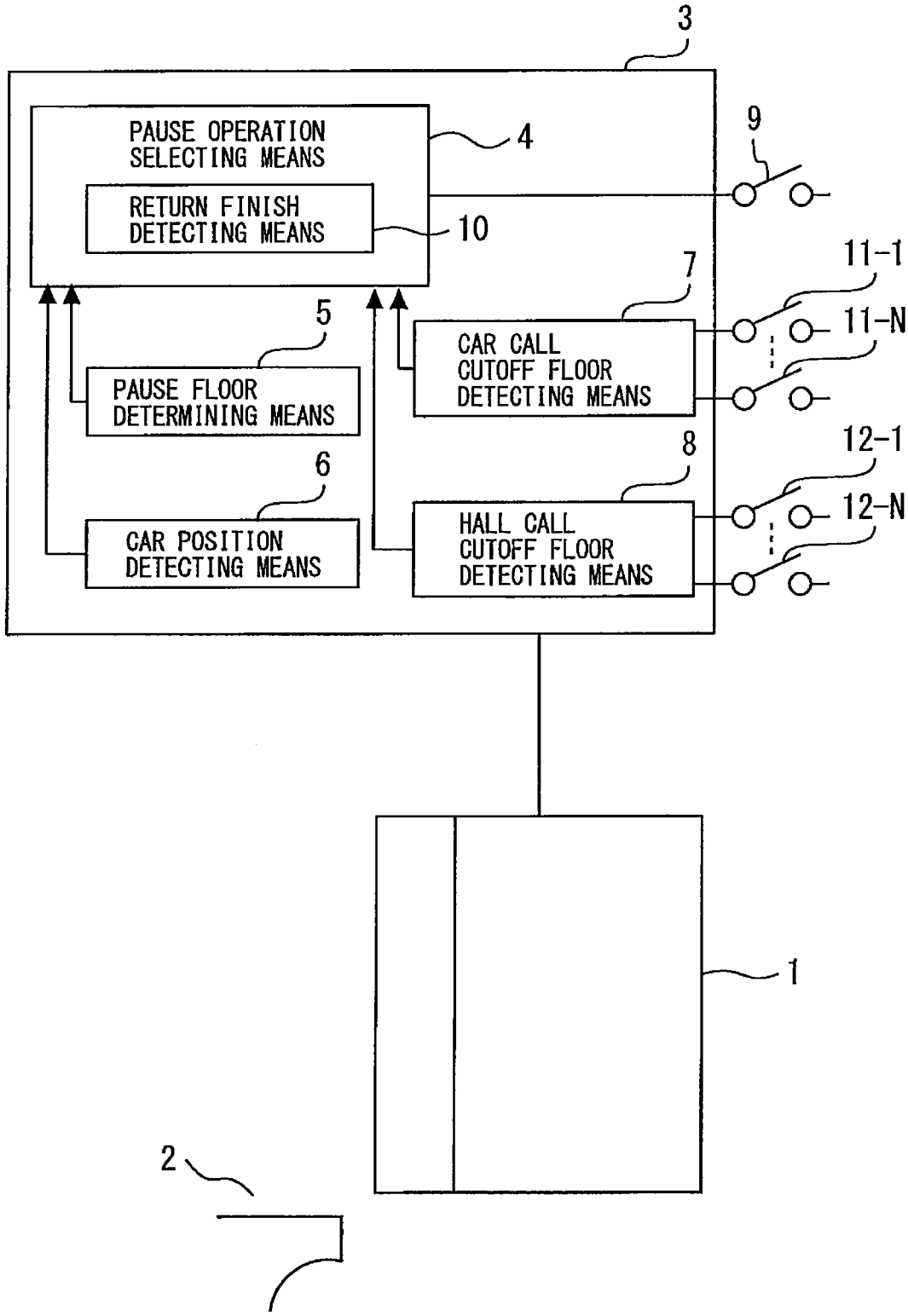
FIG. 1 is a configuration view showing an elevator control device in a first embodiment according to the present invention.

The present invention will be described in more detail with reference to the accompanying drawings. In the drawings, the same reference signs refer to the same or equivalent parts, and the redundant descriptions of these parts are appropriately simplified or omitted.

First Embodiment

FIG. 1 is a configuration view showing an elevator control device in a first embodiment according to the present invention. In FIG. 1, reference sign 1 denotes a car moving up and down in an elevator shaft, 2 denotes a hall at which the car 1 stops, and 3 denotes an elevator control panel installed in a machine room, in the shaft, or the like.

The control panel 3 has a function of carrying out the control of operation of the whole of elevator, such as the running control of the car 1 and the door opening/closing control. When the elevator is normally operated, the control panel 3 performs a service for causing the car 1 to respond successively to registered hall calls and car calls. The control panel 3 also has a function of accomplishing predetermined pause operation and call cutoff in addition to the function of controlling the normal operation.

The pause operation is an operation for stopping the car 1 at a predetermined pause floor and pausing the elevator at the pause floor. Specifically, in the pause operation, after the car 1 has been run to the predetermined pause floor, an elevator door is opened once to cause the passenger in the car 1 to get off the car 1. When the door closing motion is finished after the car 1 has been stopped at the pause floor and the door has been opened, the elevator is transferred into a predetermined pause state.

The call cutoff is accomplished to improve the security of building. If the call cutoff is accomplished, even when a passenger operates a button for registering the call, the response of the car 1 to that passenger is not made.

To realize the above-described functions, the control panel 3 is provided with a pause operation selecting means 4, a pause floor determining means 5, a car position detecting means 6, a car call cutoff floor detecting means 7, and a hall call cutoff floor detecting means 8.

The pause operation selecting means 4 selects pause operation as an elevator operation based on various pieces of input information. That is, the pause operation selecting means 4 is used to change over the elevator operation to pause operation. The pause operation selecting means 4 has a basic function of transferring the elevator to pause operation when predetermined pause conditions are met.

An operation pause switch 9 is a switch for changing over the elevator operation to pause operation. This operation pause switch 9 is installed in a room for a caretaker of the building equipped with the elevator, the hall 2 on the pause floor, or the like. For example, when the operation pause switch 9 is put from the OFF state to the ON state, the pause operation selecting means 4 determines that the predetermined pause conditions are met, and changes over the elevator operation from normal operation to pause operation.

A return finish detecting means 10 provided in the pause operation selecting means 4 has a function of detecting the return of the car 1 to the pause floor in the pause operation. For example, when the pause operation is started and the car 1 stops at the pause floor, and the door closing motion is finished after the door opening motion at the pause floor, the return finish detecting means 10 detects the return finish of the car 1.

The pause operation selecting means 4 also has a function of properly determining, according to the call cutoff state, whether or not the pause operation should be selected and whether or not the pause operation should be canceled. This function of the pause operation selecting means 4 will be specifically explained later.

The pause floor determining means 5 has a function of storing the pause floor.

The car position detecting means 6 has a function of detecting the present position of the car 1 in the shaft. For example, the car position detecting means 6 calculates the travel distance of the car 1 based on a pulse signal sent from a motor encoder (not shown) or the like, and identifies the present position of the car 1.

The car call cutoff floor detecting means 7 has a function of detecting a floor for which a car call is cut off.

A car call cutoff switch 11 (a car call cutoff means) to which the car call cutoff floor detecting means 7 is connected is used to cut off a car call service and prohibit a car call from being registered from a car call button in the car 1. This car call cutoff switch 11 is provided so as to correspond to floors at which the car 1 stops (car call buttons) (N shown in FIG. 1 indicates a floor number).

The car 1 is provided with the car call buttons with which a passenger registers a destination floor (car call). When the elevator is normally operated, a passenger registers a car call by operating (pressing) the car call button. At this time, the car call cutoff switch 11 is set OFF.

On the other hand, when the car call cutoff switch 11 is changed over to ON, the control panel 3 prohibits call registration for the car call corresponding to the car call cutoff switch 11 having been changed over to ON. For example, when a car call cutoff switch 11-3 is changed over to ON, even if a passenger presses the car call button of the third floor in the car 1, that car call is not registered. The car call cutoff floor detecting means 7 identifies, based on contact information inputted from the car call cutoff switch 11, the floor for which a car call is cut off.

The hall call cutoff floor detecting means 8 has a function of detecting the floor for which a hall call is cut off.

A hall call cutoff switch 12 (a hall call cutoff means) to which the hall call cutoff floor detecting means 8 is connected is used to cut off a hall call service and prohibit a hall call from being registered from a hall button provided in the hall 2. This hall call cutoff switch 12 is provided so as to correspond to floors at which the car 1 stops (the halls 2) (N shown in FIG. 1 indicates a floor number).

In the elevator halls 2, the hall buttons such as an up button and a down button are provided. When the elevator is normally operated, a passenger registers a hall up call or a hall down call by operating (pressing) the hall button. At this time, the hall call cutoff switch 12 is set OFF.

On the other hand, when the hall call cutoff switch 12 is changed over to ON, the control panel 3 prohibits call registration for the hall call corresponding to the hall call cutoff switch 12 having been changed over to ON. For example, when a hall call cutoff switch 12-3 is changed over to ON, even if a passenger presses the hall call button in the hall 2 of the third floor, that hall call is not registered. The hall call cutoff floor detecting means 8 identifies, based on contact information inputted from the hall call cutoff switch 12, the floor for which a hall call is cut off.

Figure 2:
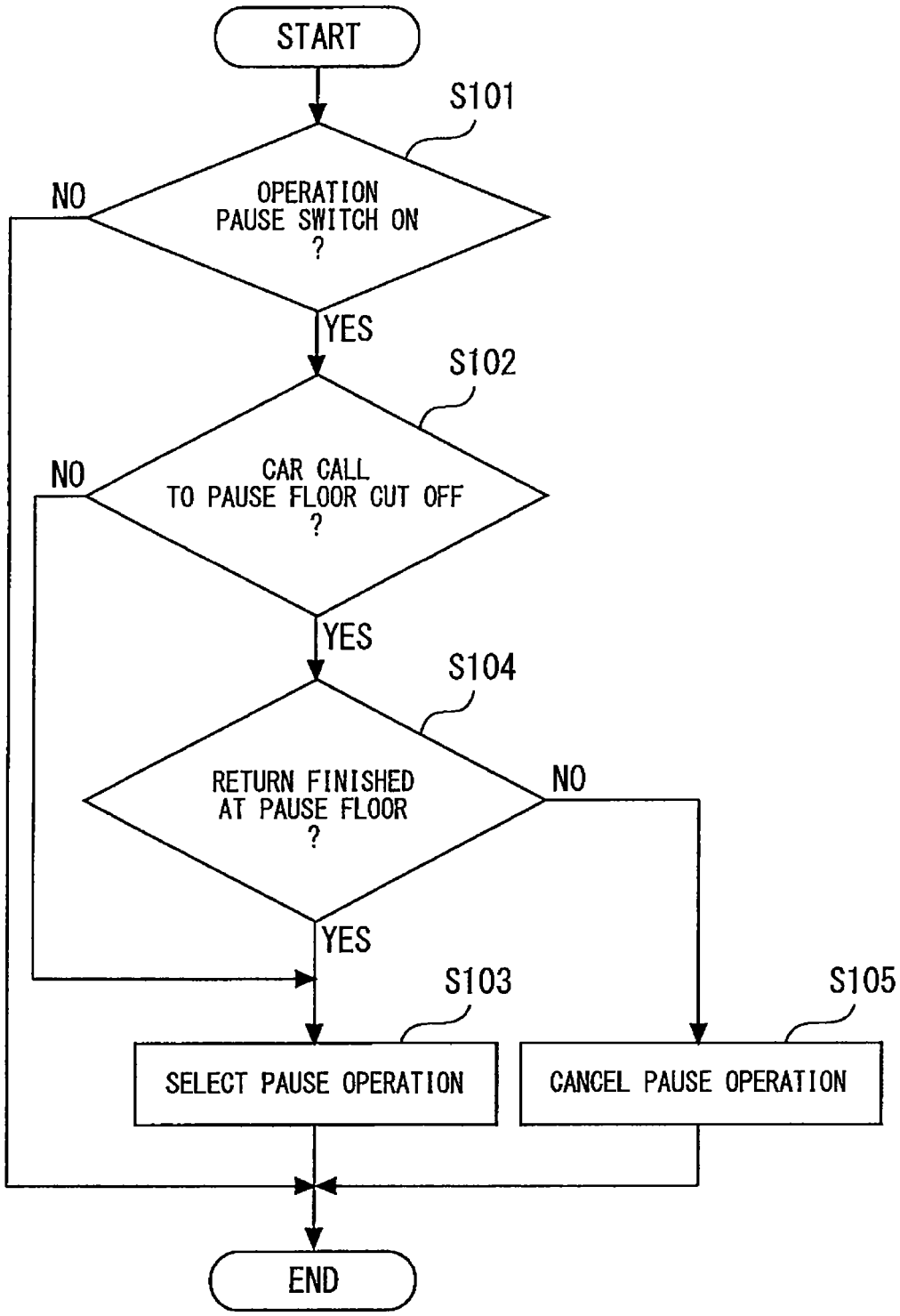
FIG. 2 is a flowchart showing the motion of the elevator control device in the first embodiment according to the present invention.
Figure 3:
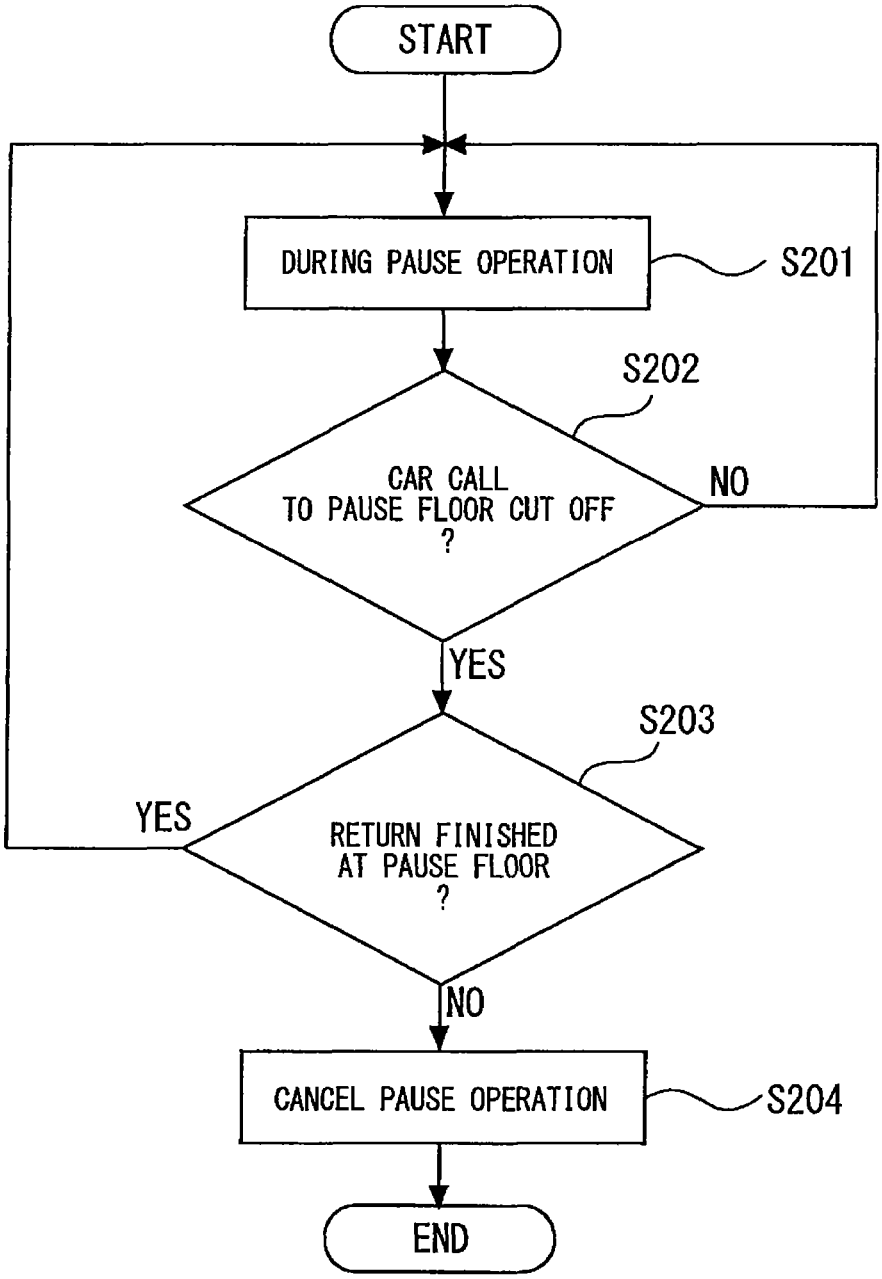
FIG. 3 is a flowchart showing the motion of the elevator control device in the first embodiment according to the present invention.

Next, referring to FIGS. 2 and 3, the motion of the control device having the above-described configuration is explained specifically. FIG. 2 is a flowchart showing the motion of the elevator control device in the first embodiment according to the present invention, showing a specific process flow of the pause operation selecting means 4 at the time when the operation pause switch 9 is changed over from OFF to ON.

Hereunder, explanation is given of the case where the pause floor has been set to the first floor in advance by the function of the pause floor determining means 5.

When the elevator is normally operated, the pause operation selecting means 4 determines whether or not the operation pause switch 9 has been changed over to ON (S101). If the operation pause switch 9 has been set OFF, the pause operation selecting means 4 does not select pause operation. That is, the control panel 3 controls the normal operation of elevator.

If the operation pause switch 9 is changed over to ON (Yes in S101), the pause operation selecting means 4 next determines whether or not the car call to the first floor (the pause floor) has been cut off. If a car call cutoff switch 11-1 has been set OFF, and the car call to the first floor has not been cut off (No in S102), the pause operation selecting means 4 selects pause operation as an elevator operation (S103).

When the car call cutoff switch 11-1 has been set OFF in S102, even if a hall call cutoff switch 12-1 has been set ON (that is, even if the hall call to the pause floor has been cut off), the pause operation selecting means 4 selects pause operation as an elevator operation (S103).

On the other hand, if, in S102, the car call cutoff switch 11-1 has been set ON, and car call cutoff for the first floor is detected by the car call cutoff floor detecting means 7 (Yes in S102), the pause operation selecting means 4 next determines whether or not the car 1 has finished returning to the pause floor (S104).

If the first floor is detected as a car position by the car position detecting means 6, and the door opening and closing motion at the first floor has been finished, the return finish of the car 1 is detected by the return finish detecting means 10 (Yes in S104). In this case, the pause operation selecting means 4 determines that the passenger has finished getting off the car 1 and no passenger is present in the car 1, and selects pause operation as an elevator operation (S103).

On the other hand, if, in S104, the return finish detecting means 10 does not detect the return finish of the car 1 (No in S104), the pause operation selecting means 4 cancels the pause operation (S105). That is, if the car call to the first floor is cut off when the elevator is normally operated, even if the operation pause switch 9 is thereafter changed over to ON and the pause conditions are met, the pause operation selecting means 4 does not transfer the elevator to pause operation. Thereby, the door opening motion is prevented from being accomplished at the pause floor for which a car call is cut off.

Next, referring to FIG. 3, explanation is given of the specific motion after the pause operation has been started.

When the pause operation has been started (S201), the pause operation selecting means 4 determines whether or not the car call to the first floor (pause floor) has been cut off (S202). If the car call cutoff switch 11-1 has been set OFF, and the car call to the first floor has not been cut off (No in S202), the pause operation selecting means 4 continues the pause operation.

If, in S202, the car call cutoff switch 11-1 has been set OFF, even if the hall call cutoff switch 12-1 has been set ON (that is, the hall call to the pause floor has been cut off), the pause operation selecting means 4 selects pause operation as an elevator operation, and continues the pause operation.

On the other hand, if the car call cutoff switch 11-1 is set ON after the start of pause operation, and the car call cutoff for the first floor is detected by the car call cutoff floor detecting means 7 (Yes in S202), the pause operation selecting means 4 next determines whether or not the car 1 has finished returning to the pause floor (S203).

If the first floor is detected as a car position by the car position detecting means 6, and the door opening and closing motion at the first floor has been finished, the return finish of the car 1 is detected by the return finish detecting means 10 (Yes in S203). In this case, the pause operation selecting means 4 determines that the passenger has finished getting off the car 1 and no passenger is present in the car 1, and continues the pause operation. That is, after the return finish of the car 1 has been detected by the return finish detecting means 10, even if the car call to the pause floor is cut off during the pause operation, the pause operation selecting means 4 continues the pause operation as it is.

On the other hand, if, in S203, the return finish detecting means 10 does not detect the return finish of the car 1 (No in S203), the pause operation selecting means 4 cancels the pause operation (S204). That is, if the car call to the pause floor is cut off at a time during the time from when the pause conditions are met to when the return finish of the car 1 is detected by the return finish detecting means 10, the pause operation selecting means 4 cancels the pause operation, and prevents the door opening motion from being accomplished at the pause floor.

According to the first embodiment of the present invention, in the elevator control device provided with both of the pause operation function and the call cutoff function, the selection and cancellation of pause operation can be made properly according to the call cutoff state. That is, even in the case where the pause operation and the cutoff of call to pause floor overlap, an optimal operation in accordance with the state can be performed without decreasing the building security and without impairing the normal function of pause operation.

INDUSTRIAL APPLICABILITY

The elevator control device of the present invention can be applied to an elevator provided with both of the pause operation function and the call cutoff function.

REFERENCE SIGNS LIST

1 car
2 hall
3 control panel
4 pause operation selecting means
5 pause floor determining means
6 car position detecting means
7 car call cutoff floor detecting means
8 hall call cutoff floor detecting means
9 operation pause switch
10 return finish detecting means
11 car call cutoff switch
12 hall call cutoff switch

The invention claimed is:

1. An elevator control device comprising:

a pause operation selector for stopping a car at a predetermined pause floor, closing a door after door opening motion, and pausing an elevator by transferring the elevator to pause operation if predetermined pause conditions are met; and a car call cutoff device for prohibiting a car call from being registered from a car call button in the car by cutting off the car call, wherein when the car call to the pause floor has been cut off by the car call cutoff device, even if the predetermined pause conditions are met, the pause operation selector does not transfer the elevator to pause operation.

2. The elevator control device according to claim 1, further comprising:

a return finish detector for detecting the return finish of the car when the car stops at the pause floor in the pause operation, and the door is closed after the door opening motion, wherein the pause operation selector cancels the pause operation if the car call to the pause floor is cut off by the car call cutoff device at a time during the time from when the pause conditions are met to when the return finish is detected by the return finish detector.

3. The elevator control device according to claim 2, wherein after the return finish has been detected by the return finish detector, the pause operation selector continues the pause operation even if the car call to the pause floor is cut off by the car call cutoff device during the pause operation.

4. The elevator control device according to claim 1, further comprising:

a hall call cutoff device for prohibiting a hall call from being registered from a hall button in a hall by cutting off the hall call, wherein when the car call to the pause floor has not been cut off by the car call cutoff device, the pause operation selector continues the pause operation even if the hall call to the pause floor is cut off by the hall call cutoff device during the pause operation.

5. The elevator control device according to claim 2, further comprising:

a hall call cutoff device for prohibiting a hall call from being registered from a hall button in a hall by cutting off the hall call, wherein when the car call to the pause floor has not been cut off by the car call cutoff device, the pause operation selector continues the pause operation even if the hall call to the pause floor is cut off by the hall call cutoff device during the pause operation.

6. The elevator control device according to claim 3, further comprising:

a hall call cutoff device for prohibiting a hall call from being registered from a hall button in a hall by cutting off the hall call, wherein when the car call to the pause floor has not been cut off by the car call cutoff device, the pause operation selector continues the pause operation even if the hall call to the pause floor is cut off by the hall call cutoff device during the pause operation.

* * * * *